US007011032B1

(12) United States Patent
Chang

(10) Patent No.: US 7,011,032 B1
(45) Date of Patent: Mar. 14, 2006

(54) CONTROL MECHANISM FOR DRIVING UPPER LOOPER OF SEWING MACHINES

(76) Inventor: Tseng Hsien Chang, 9F, No. 270, Gaogong Rd., South District, Taichung City 402 (TW)

( * ) Notice: Subject to any disclaimer, the term of this patent is extended or adjusted under 35 U.S.C. 154(b) by 0 days.

(21) Appl. No.: 11/023,518

(22) Filed: Dec. 29, 2004

(51) Int. Cl.
*D05B 69/00* (2006.01)

(52) U.S. Cl. ..... 112/200

(58) Field of Classification Search ..... 112/200, 112/284, 220, 162, 199, 177, 197
See application file for complete search history.

(56) References Cited

U.S. PATENT DOCUMENTS 2,946,301 A * 7/1960 Hacklander ..... 112/200
4,649,841 A * 3/1987 Koshinaka ..... 112/129
4,690,080 A * 9/1987 Mikuni et al. ..... 112/162
5,233,935 A * 8/1993 Winter ..... 112/199
5,664,509 A * 9/1997 Tseng ..... 112/200
5,732,639 A * 3/1998 Kojima et al. ..... 112/162

* cited by examiner

*Primary Examiner*—Ismael Izaguirre
(74) *Attorney, Agent, or Firm*—Rosenberg, Klein & Lee

(57) ABSTRACT

An upper looper control mechanism for sewing machines includes a control member and an end member connected between an active shaft for driving the upper looper and a connection member which is connected with the upper looper. The control member has one end connected to the active shaft or the connection member, and the other end of the control member is connected to a fixed part of the sewing machine. The users operate the control member to transfer the power of the active shaft to the connection member or to disengage the power of the active shaft from the connection member, so as to activate the upper looper or to stop the upper looper.

11 Claims, 5 Drawing Sheets

CONTROL MECHANISM FOR DRIVING UPPER LOOPER OF SEWING MACHINES

FIELD OF THE INVENTION

The present invention relates to a control mechanism for driving the upper looper, and more particularly, to a control member for activating or stopping the upper looper. The control mechanism includes simple and reliable structure.

BACKGROUND OF THE INVENTION

A conventional way to control the travel of the upper looper of a sewing machine is disclosed in U.S. Pat. No. 5,664,509 which discloses an action member and a connection member which is located between the action member and a swing member. By the change of positions of the action member and the connection member, the travel of the upper looper is controlled. However, it includes a complicated structure which is difficult to manufacture and maintain. Improvements are expected to develop a simple mechanism to control the travel of the upper looper.

The present invention intends to provide control mechanism that uses a control member which is pivoted between an operation position to connect the power of the active shaft to the upper looper, and a stop position to remove the power of the active shaft from the upper looper.

SUMMARY OF THE INVENTION

The present invention relates to an upper looper control mechanism for sewing machines which includes an active shaft for input power to drive the upper looper. The upper looper control mechanism comprises a connection member connected with the upper looper and a control member connected between the active shaft and the connection member. The control member is operated between an operation position for connecting the active shaft to the connection member to activate the upper looper, and a stop position for disengaging the active shaft from the connection member to stop the upper looper.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
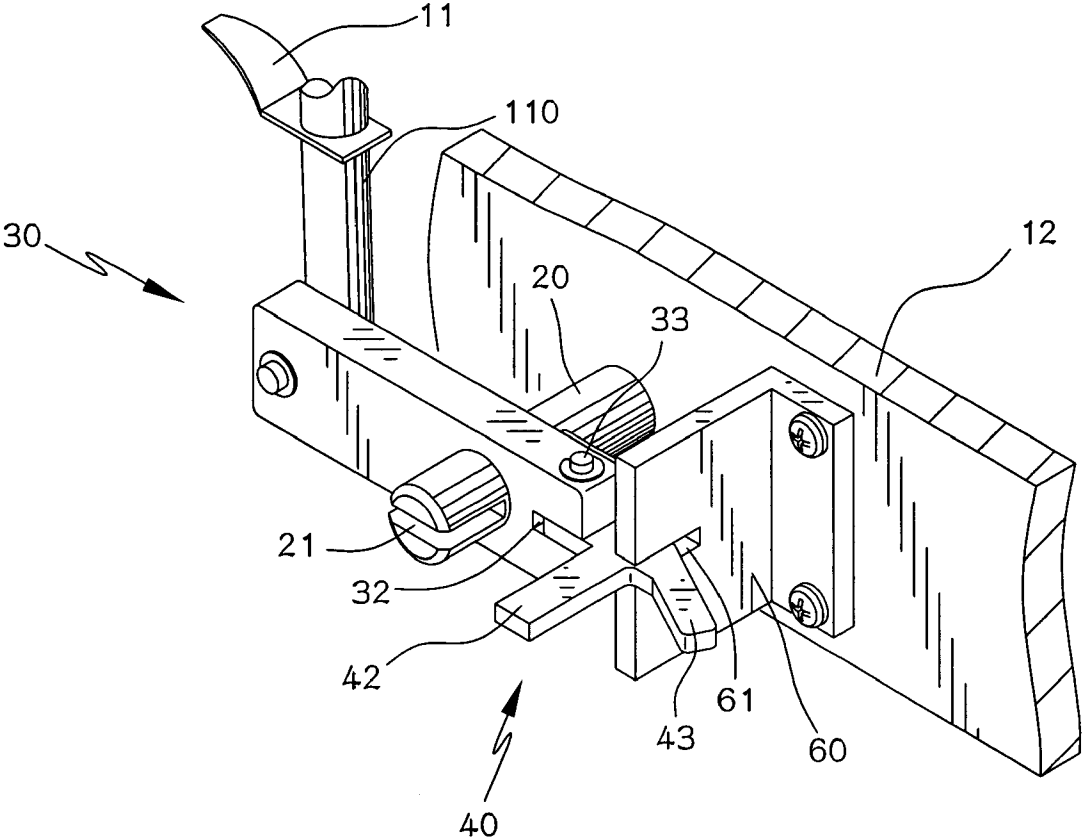
FIG. 1 is a perspective view to show the upper looper control mechanism of the present invention.
Figure 2:
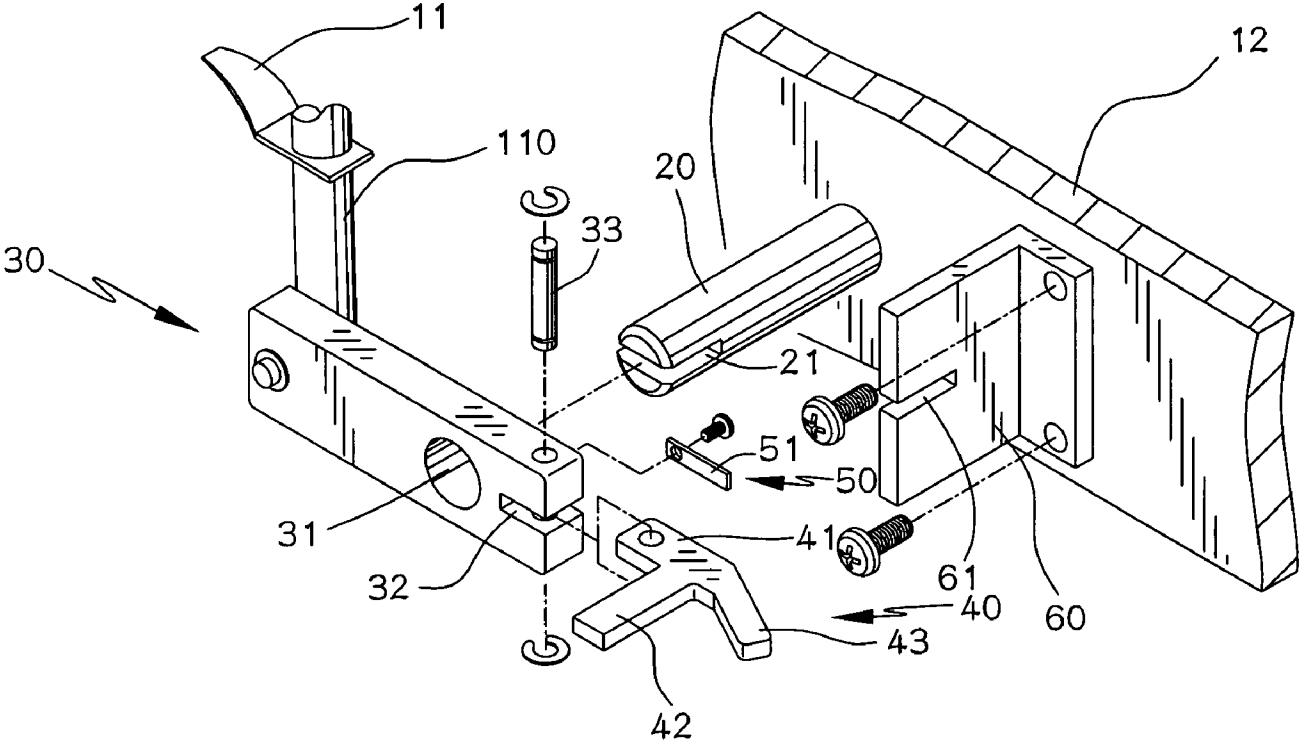
FIG. 2 is an exploded view to show the upper looper control mechanism of the present invention.
Figure 3:
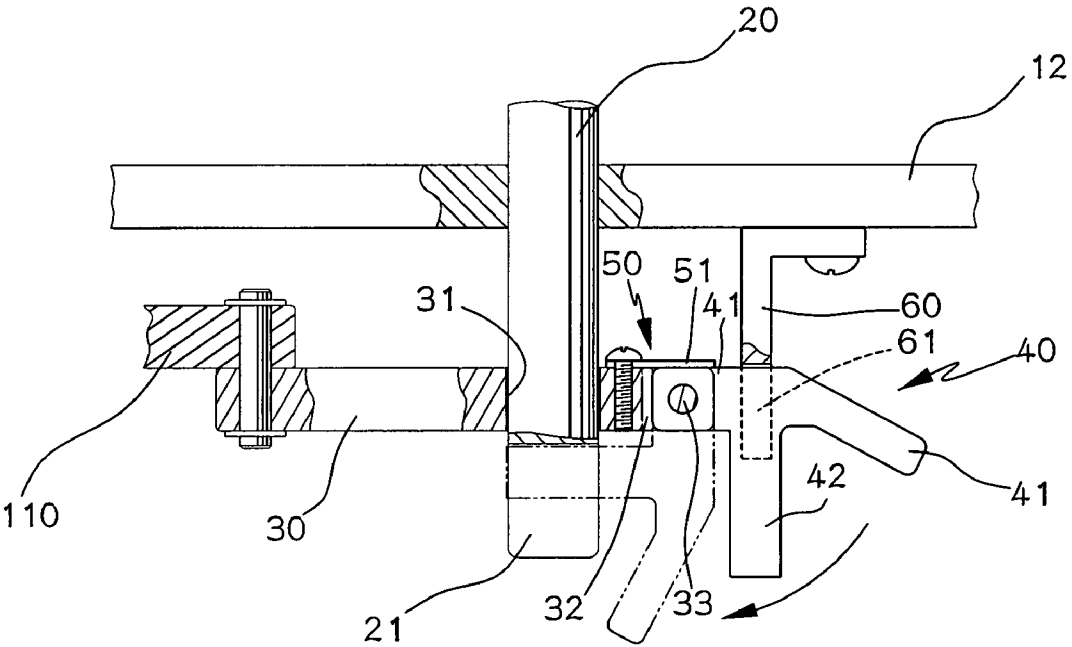
FIG. 3 shows the operation of the control member between two positions.

Referring to FIGS. 1 to 3, the present invention provides a control member 40 located between a distal end of an active shaft 20 and a connection member 30. The active shaft

20 provides power to the upper looper 11 which is connected to the connection member 30. The active shaft 20 extends through the frame 12 of the sewing machine 10 and a first slot 21 is defined in the distal end of the active shaft 20.

The connection member 30 has one end pivotably connected to a driving member 110 which is connected to the upper looper 11 and a hole 31 is defined through a middle portion of the connection member 30 so that the active shaft 20 extends through the hole 31 and the distal end with the first slot 21 extends beyond the connection member 30. The other end of the connection member 30 has a second slot 32 and a pin 33 extends vertically through the end and pivotably connects a connection end 41 of the control member 40 in the second slot 32.

The control member 40 includes an engaging portion 42 and an operation portion 43 such that when a user pivots the operation portion 43, the control member 40 is pivoted about the pin 33, the engaging portion 42 can be engaged with or disengaged from the first slot 21 of the active shaft 20 as shown in FIG. 3. When the engaging portion 42 is engaged with the first slot 21, the operation position of the control member 40, the active shaft 20, the connection member 30 and the control member 40 are operated as one piece so that the power from the active shaft 20 drives the upper looper 11. When the engaging portion 42 is disengaged from the first slot 21, the stop position of the control member 40, the power from the active shaft 20 cannot drive the upper looper 11.

A limitation member 50 is located close to the control member 40 and has one end fixed to the connection member 30 and the other end of the limitation member 50 is a limitation piece 51 which biases the connection end 41 of the control member 40 so as to position the control member 40 at the operation position and the stop position.

A retaining member 60 has a first end fixed on the frame 12 and a second end of the retaining member 60 extends toward the control member 40, an engaging slot 61 is defined in the second end of the retaining member 60 so that the control member 40 is engaged with the engaging slot 61 when in the stop position.

Figure 4:
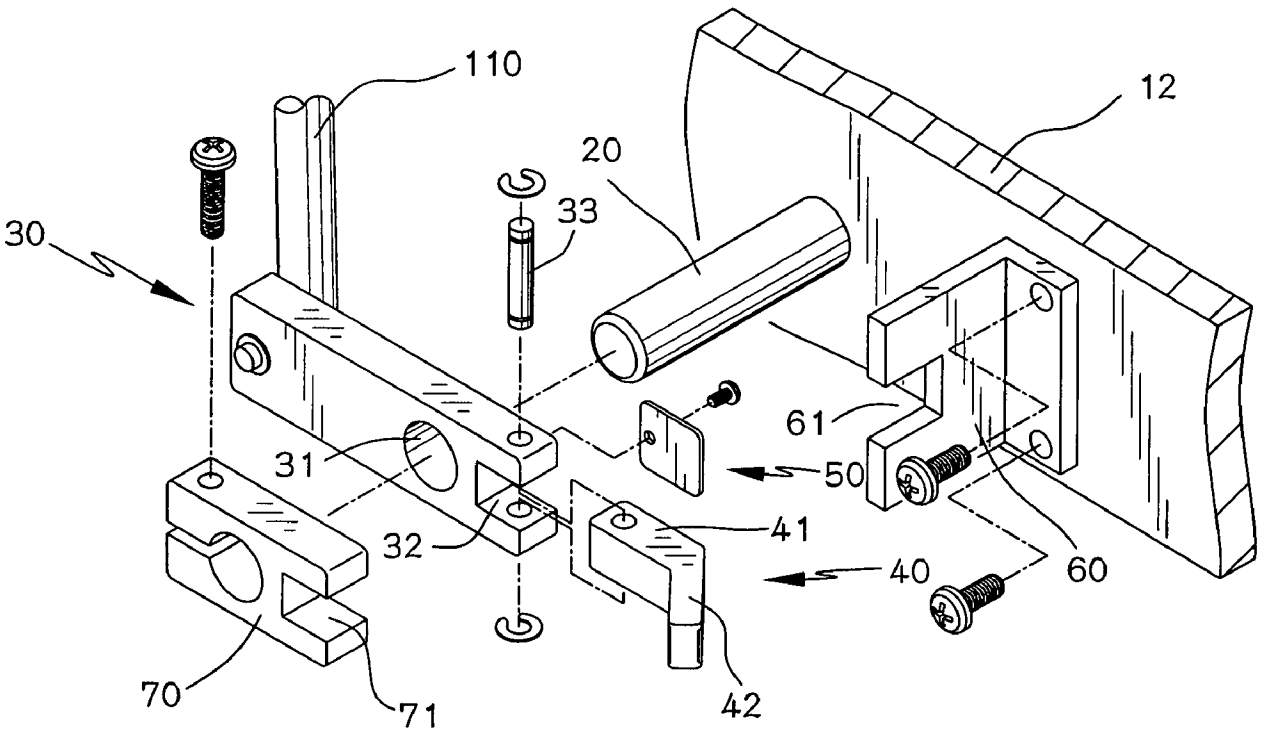
FIG. 4 is an exploded view to show another embodiment of the upper looper control mechanism of the present invention.
Figure 5:
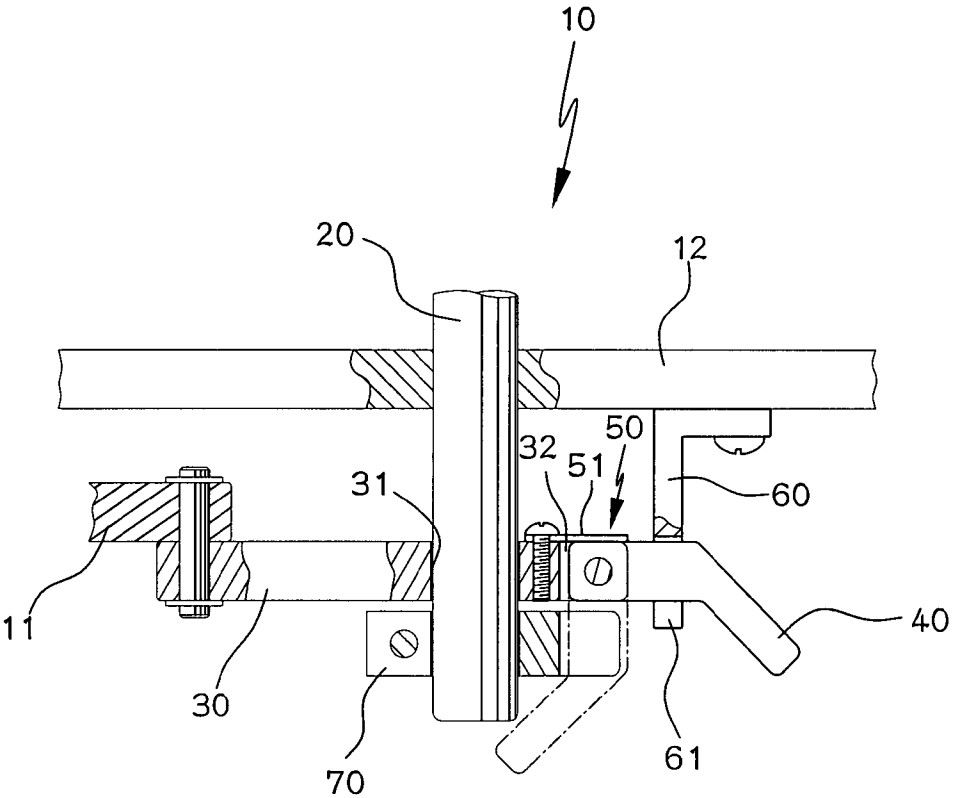
FIG. 5 shows the operation of the control member in FIG. 4 between two positions.

FIGS. 4 and 5 show that the control member 40 is not directly engaged with the active shaft 20, there is an end member 70 connected to the distal end of the active shaft 20. The end member 70 has one end split into two parallel parts so that a screw extends through the two parts to secure the end member 70 to the active shaft 20. The other end of the end member 70 has an engaging slot 71 so as to be engaged with the engaging portion 42 of the control member 40 to transfer the power of the active shaft 20 to the upper looper 11.

The mechanism includes a simple structure and includes a control member 40 which controls the operation of the upper looper 11 so that the manufacturing cost is extremely low.

The limitation member 50 assists the positioning of the control member 40 to make the operation more reliable.

While we have shown and described the embodiment in accordance with the present invention, it should be clear to those skilled in the art that further embodiments may be made without departing from the scope of the present invention.

What is claimed is:

1. An upper looper control mechanism for sewing machines which includes an active shaft, comprising:

a connection member connected with an upper looper;

a control member connected between the active shaft and the connection member, the control member being operated between an operation position for connecting the active shaft to the connection member to activate the upper looper, and a stop position for disengaging the active shaft from the connection member to stop the upper looper, and a retaining member located close to the control member and one end of the retaining member fixed to a frame and the other end of the retaining member extending toward the control member so as to position the control member at the operation position and the stop position.

2. The mechanism as claimed in claim 1, wherein an engaging portion of the control member is pivotably located between the active shaft and the connection member.

3. The mechanism as claimed in claim 1, wherein a limitation member is located close to the control member and includes a limitation piece located close to the control member.

4. An upper looper control mechanism for sewing machines which includes an active shaft, comprising:

an end member connected to the active shaft;

a connection member connected with an upper looper;

a control member connected between the end member and the connection member, the control member being operated between an operation position for connecting the end member to the connection member to activate the upper looper, and a stop position for disengaging the end member from the connection member to stop the upper looper, and a retaining member located close to the control member and one end of the retaining member fixed to a frame and the other end of the retaining member extending toward the control member so as to position the control member at the operation position and the stop position.

5. The mechanism as claimed in claim 4, wherein an engaging portion of the control member is pivotably located between the end member and the connection member.

6. The mechanism as claimed in claim 4, wherein a limitation member is located close to the control member and includes a limitation piece located close to the control member.

7. An upper looper control mechanism for sewing machines which include an active shaft, comprising:

a connection member connected with an upper looper, and a control member connected between the active shaft and the connection member, the control member including a connection end and an engaging portion, the connection end pivotably connected to one end of the connection member, the engaging portion removably stopped by the active shaft, the control member being operated between an operation position for connecting the active shaft to the connection member to activate the upper looper, and a stop position for disengaging the active shaft from the connection member to stop the upper looper.

8. The mechanism as claimed in claim 7, wherein the connection member has a slot defined in the end thereof and a pin extends through the end so that the connection end of the control member is pivotably engaged with the slot.

9. The mechanism as claimed in claim 7, wherein the active shaft includes a second slot and the engaging portion of the control member is removably engaged with the second slot.

10. The mechanism as claimed in claim 7, wherein an end member connected to the active shaft: and a control member connected between the end member and the connection member, the control member being operated between an operation position for connecting the end member to the connection member to activate the upper looper, and a stop position for disengaging the end member from the connection member to stop the upper looper.

11. The mechanism as claimed in claim 10, wherein the end member has an engaging slot and the engaging portion of the control member is removably engaged with the engaging slot.

* * * * *